US005645026A

United States Patent [19]

Schlessmann

[11] Patent Number: 5,645,026

[45] Date of Patent: Jul. 8, 1997

[54] INTERNAL COMBUSTION ENGINE FOR A PORTABLE HANDHELD WORK APPARATUS

[75] Inventor: Helmut Schlessmann, Prüm, Germany

[73] Assignee: Andreas Stihl, Waiblingen, Germany

[21] Appl. No.: 692,102

[22] Filed: Aug. 5, 1996

[30] Foreign Application Priority Data

Aug. 12, 1995 [DE] Germany ..... 295 13 019.9

[51] Int. Cl.[6] ..... F02M 29/00

[52] U.S. Cl. ..... 123/184.46; 123/184.61; 123/73 C

[58] Field of Search ..... 123/184.61, 184.46, 123/73 C, 435, 73 A

[56] References Cited

U.S. PATENT DOCUMENTS

| | | | |
|---|---|---|---|
| 4,711,225 | 12/1987 | Holderle et al. | 123/184.61 |
| 4,716,878 | 1/1988 | Shimada et al. | 123/184.61 |
| 4,835,866 | 6/1989 | Nagashima | 123/73 AD |
| 5,065,708 | 11/1991 | Wehle et al. | 123/184.61 |
| 5,317,995 | 6/1994 | Brummer et al. | 123/184.61 |
| 5,353,752 | 10/1994 | Suzuki | 123/184.61 |
| 5,474,039 | 12/1995 | Doragrip | 123/184.61 |

*Primary Examiner*—David A. Okonsky
*Attorney, Agent, or Firm*—Walter Ottesen

[57] ABSTRACT

The invention relates to an internal combustion engine for a portable handheld work apparatus such as a motor-driven chain saw or the like. The internal combustion engine includes a cylinder defining a combustion chamber and having an inlet passage for conducting a fuel mixture into the combustion chamber. The cylinder has an annular flange formed thereon and is disposed in surrounding relationship to the inlet passage. An intake pipe defines a longitudinal axis and has an end section. The end section and the annular flange are axially inserted one into the other in overlapping relationship to each other. The annular flange and the end section conjointly define an annular space therebetween radially of the longitudinal axis and a seal is clamped between the annular flange and the end section in the annular space.

15 Claims, 4 Drawing Sheets

INTERNAL COMBUSTION ENGINE FOR A PORTABLE HANDHELD WORK APPARATUS

FIELD OF THE INVENTION

The invention relates to an internal combustion engine for a portable handheld work apparatus, such as a motor-driven chain saw.

BACKGROUND OF THE INVENTION

A device for mounting a carburetor on an internal combustion engine is disclosed in U.S. Pat. No. 4,835,866. In this device, the intake pipe is attached to a cylinder flange via a sealing ring. The end faces of the cylinder flange and the intake pipe face each other and are axially spaced relative to each other. The end faces have respective flanges which are surroundingly form tight engaged by corresponding ones of axial end sections of the sealing ring. The sealing ring is made of an elastic material, such as rubber, in order to ensure an adequately high elasticity for the assembly and in order to compensate for manufacturing tolerances of the cylinder flange and intake pipe. The elastic sealing ring attenuates the engine vibrations in order to substantially keep vibrations away from the carburetor attached to the intake pipe.

The sealing ring can swell because of the influence of fuel whereby the attachment of the sealing ring to the cylinder flange and to the intake pipe can loosen. The integrity of the seal is affected. In this way, unwanted air can be inducted whereby the mixture supplied to the engine can be changed in a disadvantageous manner. The connection can loosen when mechanical loads occur such as intense vibrations or bumping.

It is also known to fix the sealing ring via pipe clamps on the cylinder and on the intake pipe. This connection can withstand higher mechanical loading but the sealing ring is subjected to increased loading in the region of the pipe clamp connection because of the material being squeezed. In this region, the problem of fissure formation is increased with the result that the connection will no longer be tight.

SUMMARY OF THE INVENTION

It is an object of the invention to configure the connection of an intake pipe at the cylinder flange of a cylinder so that a permanent seal is ensured, even in the presence of unfavorable influences and so that a connection is provided which facilitates assembly and has excellent operating reliability.

The internal combustion engine of the invention is for a portable handheld work apparatus, such as a motor-driven chain saw or the like. The internal combustion engine includes a cylinder defining a combustion chamber interior space and having an inlet passage for conducting a fuel mixture into the combustion chamber; the cylinder having an annular flange formed thereon and disposed in surrounding relationship to the inlet passage; an intake pipe defining a longitudinal axis and having an end section; the end section and the annular flange being axially inserted one into the other in overlapping relationship to each other; the annular flange and the end section conjointly defining an annular space therebetween radially of the longitudinal axis; and, a seal clamped between the annular flange and the end section in the annular space.

The seal is tightly clamped radially between the cylinder flange and the end section of the intake pipe. This seal ensures a high degree of tightness even after being wetted with fuel and after swelling caused thereby since the seal is delimited on its radial inner-lying end as well as at its radially outer-lying end by the cylinder flange and the end section of the intake pipe. Swelling of the seal increases the radial pressure in the seal space whereby the seal function is improved.

A further advantage is the small structural elevation of the connection because, as a result of the mutual insertion of parts, the cylinder flange, the seal and the end section of the intake pipe have essentially the same structural elevation.

A further advantage is the low number of components and the simple assembly and disassembly. Especially for a seal configured to be oversized, the component to be inserted in or inserted over is axially fixed without additional attachment measures. Additional attaching measures are not perforce necessary. The friction lock is provided essentially via the total elevation on the radial outer side and inner side of the seal. High friction forces can be transmitted which become uniformly distributed over the seal wall so that the problem of fissure formation is reduced.

The cylinder flange is advantageously configured as a radial outer-lying component in which the seal and the end section of the intake pipe are inserted. The cylinder flange can have an inner-lying annular shoulder which defines a stop for the seal to be inserted. The wall of the cylinder flange extends from the annular step and the axial structural elevation of the wall corresponds approximately to that of the seal.

An annular gap is provided between the annular step and the end face of the end section of the intake pipe. This annular gap has an outer end defined by the seal. Swelling of the seal causes the seal to expand radially into the annular gap thereby ensuring that the seal retains its elastic characteristics.

The inner wall of the intake pipe and the inner wall of the inlet passage both lie in a common surface which is only interrupted by the axially narrow annular gap. In this way, an advantageous flow in the transition section between the end section and the inlet passage in the cylinder is obtained. It can be advantageous to provide here a conical configuration of the intake pipe.

The seal advantageously includes a flange in which a pulse bore is introduced to transmit the crank case pressure to a membrane feed pump. The pulse bore lies approximately axially parallel to the opening defined by the seal and connects the pulse opening in the cylinder to a pulse channel which is formed in an edge section of the intake pipe. The flange mounted on a wall end of the seal, together with the pulse bore, ensures a defined assembly position of the seal in the cylinder flange.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
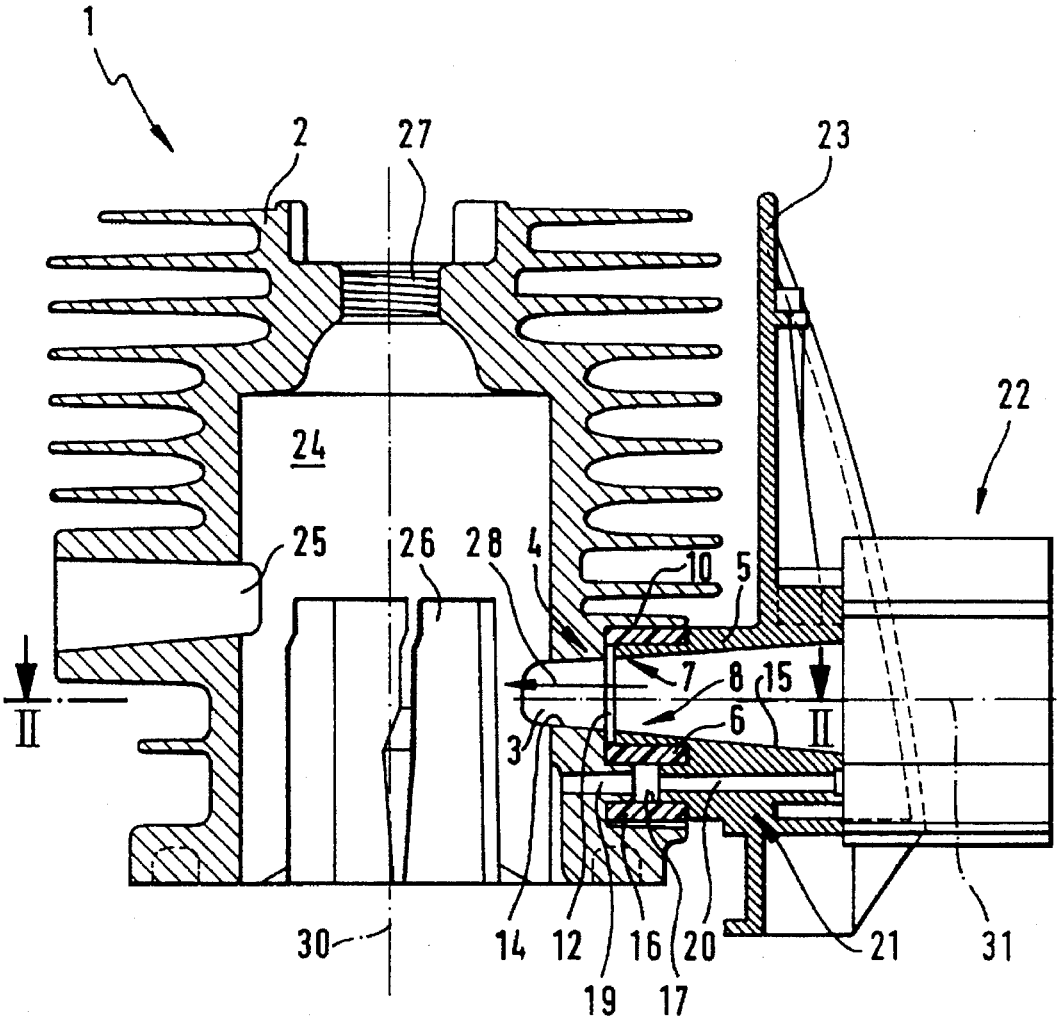
FIG. 1 is a section view taken through a cylinder of an internal combustion engine having a cylinder flange, seal and intake pipe.

FIG. 1 shows the cylinder 2 of an internal combustion engine 1 which is especially a two-stroke engine in a portable handheld work apparatus such as a motor-driven chain saw, cutoff machine, brushcutter, or the like. An inlet opening 3 opens into the combustion chamber 24 of the cylinder 2 for conducting an ignitable air/fuel mixture. An outlet passage 25 is provided on the side of the combustion chamber 24 lying opposite the inlet passage 23. Furthermore, transfer channels 26 are provided in the cylinder wall. A threaded opening 27 is provided in the head of the cylinder to accommodate a spark plug.

The inlet passage 3 extends into a cylinder flange 4 configured as one piece integrally with the cylinder wall. An intake pipe 5 is inserted into the flange opening 8. A carburetor 22 supplies fuel to the intake pipe 5. The fuel is processed with supplied combustion air in the venturi section of the intake pipe 5 to form an ignitable mixture. The mixture is conducted in flow direction 28 to the combustion chamber 24 of the cylinder 2.

Figure 5:
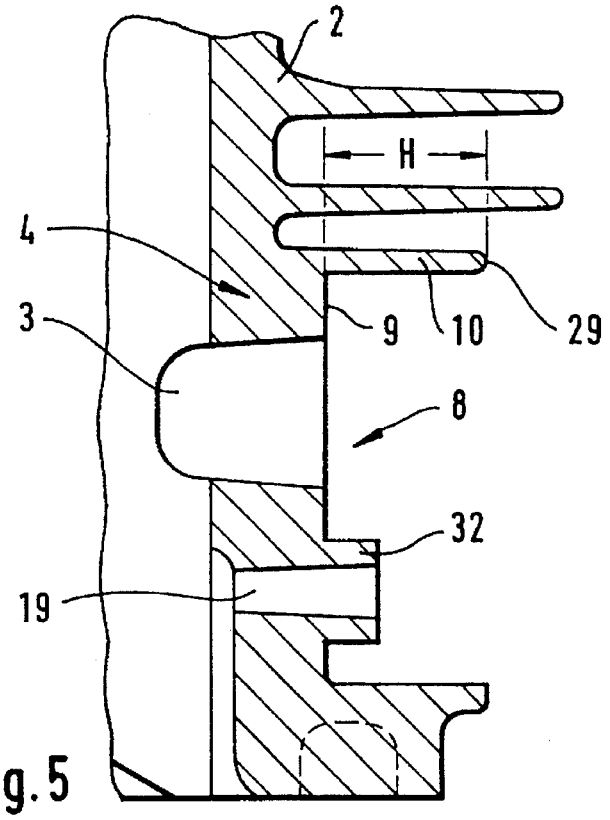
FIG. 5 is a detail view of a portion of the cylinder of FIG. 3 showing the annular flange thereof; and, FIG. 6 is an enlarged detail view of the end section of the intake pipe.

The cylinder flange 4 on the cylinder 2 defines a receptacle into which the pipe end section 7 of the intake pipe 5 is inserted. An annularly-shaped flange wall 10 is formed on the cylinder flange 4 and delimits the flange opening 8 as shown in FIGS. 1 and 5. The flange wall 10 surroundingly engages the intake pipe 5 inserted into the flange opening 8. A seal 6, which is configured as a sealing ring, is seated in the annular space between the flange wall 10 and the pipe end section 7 of the intake pipe 5.

Figure 4A:
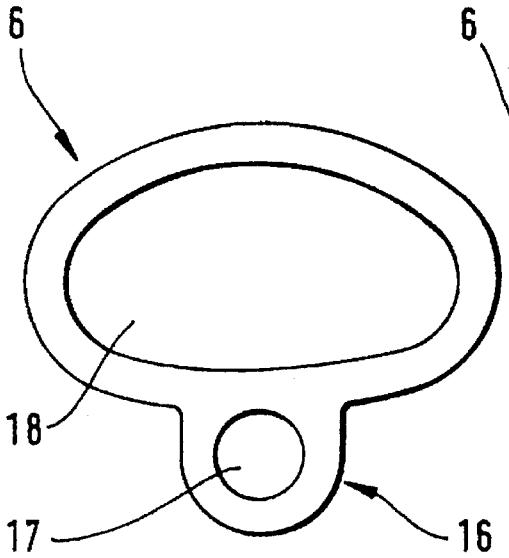
FIG. 4*a* is an end view of the annular seal juxtaposed between the annular flange of the cylinder and the end section of the intake pipe.
Figure 4B:
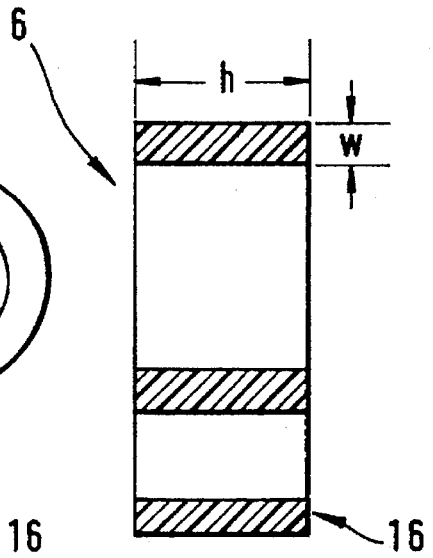
FIG. 4*b* is a section view of the annular seal of FIG. 4*a*.

The axial structural elevation (h) of the seal 6 corresponds approximately to the axial structural elevation (H) of the flange wall 10 so that the sealing ring terminates axially with the end face 29 of the flange wall 10 as shown in FIGS. 1, 4*b* and 5. The sealing ring is inserted completely into the flange opening 8 and is advantageously manufactured to have an oversize compared to the diameter of the flange opening 8 so that the seal ring is tightly held in the flange opening 8 after being pressed therein.

The pipe end section 7 of the intake pipe 5 is inserted into the seal 6. The outer diameter D of the pipe end section 7 (FIG. 6) is manufactured with an oversize compared to the seal inner diameter so that the intake pipe 5 applies a radial contact pressure to the seal 6 which is taken up by the surroundingly engaging flange wall 10 of the cylinder flange 4. The intake pipe 5 is inserted into the flange opening 8. In this way, a uniform radial pressure is applied over essentially the entire axial structural elevation of the seal. The axial friction forces which occur between the tube end section 7 and the seal 6 and between the seal 6 and the flange wall 10 prevent an axial loosening of the attachment.

An inner-lying annular step 9 is provided in the cylinder flange 4 and faces toward the intake pipe 5. The annular step defines the base of the flange opening as shown in FIG. 5 and delimits the insert depth of the seal 6 into the flange opening 8. The annular step 9 forms a stop for the seal 6 inserted into the flange opening. The radial thickness (w) of the seal wall (FIG. 4*b*) is less than the radial extent of the annular step 9. The remaining radial extent of the wall is filled out by the wall of the pipe end section 7 so that the inner wall 15 of the intake pipe 5 and the inner wall 14 of the inlet passage 3, which extends from the flange opening 8, both lie in a common imaginary generated surface of revolution.

Figure 2:
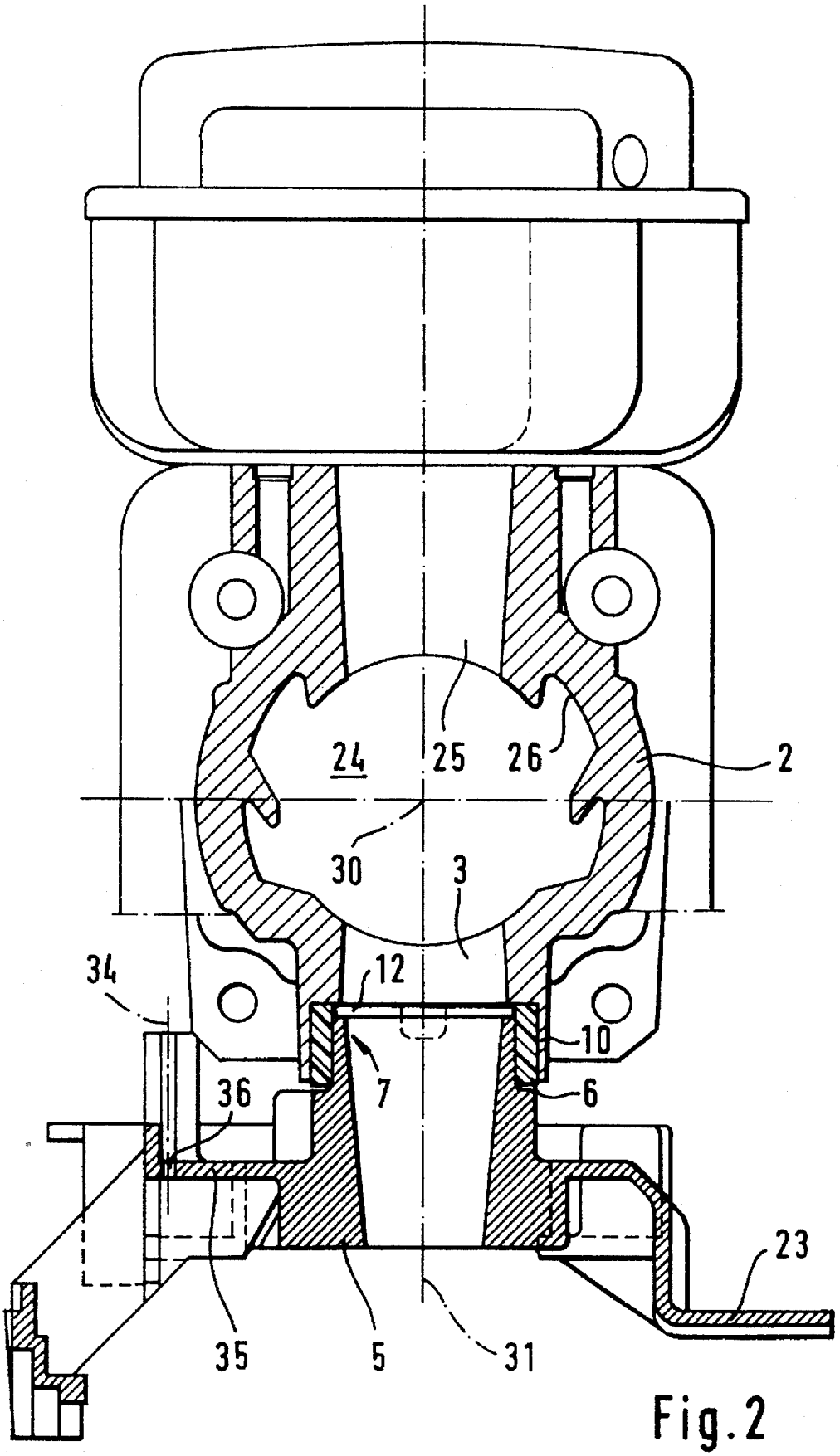
FIG. 2 is a section view taken along line II—II of FIG. 1.
Figure 6:
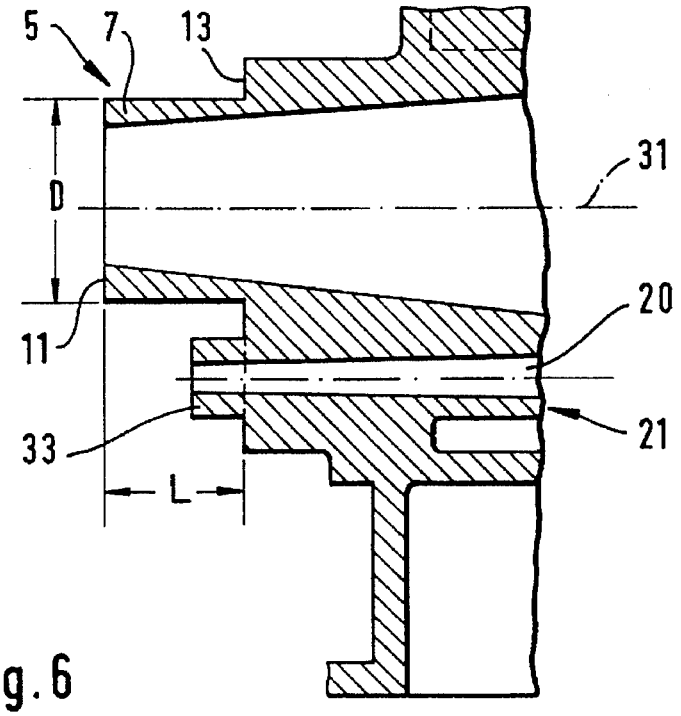

As shown in FIGS. 1 and 2, this imaginary generated surface is only interrupted by an annular gap 12 which is formed in that the axial structural length L of the pipe end section 7 of the intake pipe 5 is less than the structural elevation H of the flange wall 10 (see FIGS. 5 and 6).

An annular step 13 is formed in the outer surface of the intake pipe and delimits the insert depth of the intake pipe into the flange opening 8 in that the annular step 13 can be inserted maximally up to the stop on the end face 29 of the flange wall 10 or to the end face of the seal. The annular gap 12 provides a compensating space for swelling seal material when a possible swelling of the seal 6 occurs because of being wetted with fuel. The annular gap ensures that the structurally elastic characteristics of the seal are retained.

An axial intermediate space can be retained into which the seal material can extend. The axial intermediate space is disposed between the annular step 13 on the intake pipe 5 and the end face 29 of the flange wall 10 and provides a further compensating space for swelling seal material.

As shown in FIGS. 1 and 6, the interior of the pipe defines a conical trace when viewed in projection on a longitudinal plane extending along the cylinder 2. The pipe interior tapers in the direction of the combustion chamber 24. The interior of the pipe conically expands in the direction of the combustion chamber 24 in a plane perpendicular to the longitudinal axis 30 of the cylinder as shown in FIG. 2.

Figure 3:
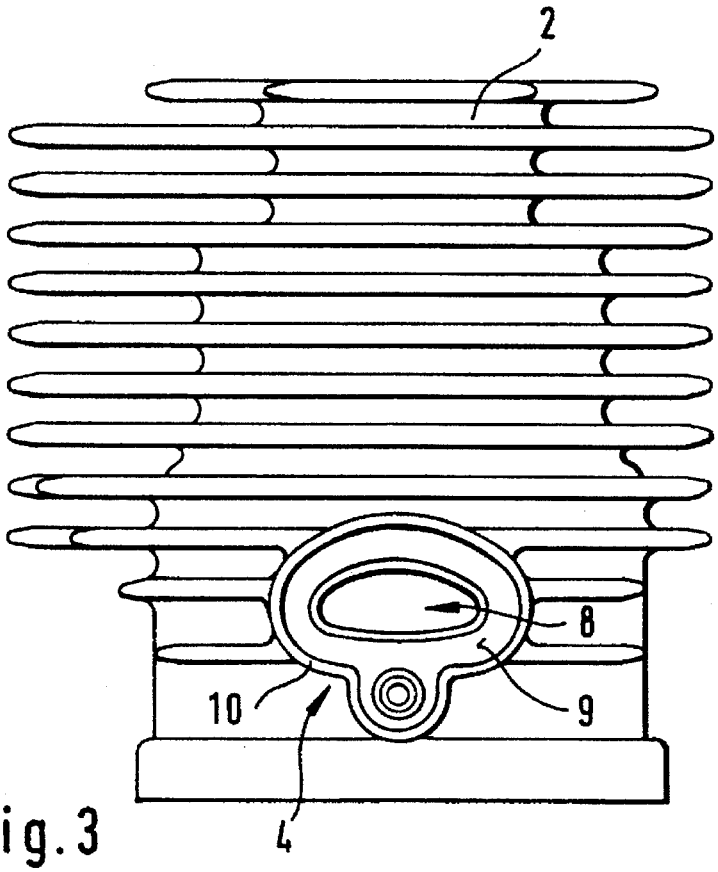
FIG. 3 is a side elevation view of the cylinder having a cylinder flange.

From FIGS. 3 and 4*a*, it can been seen that the flange opening 8 of the cylinder flange 4 and the seal 6 inserted therein have an approximately oval cross section. The intake pipe 5 is correspondingly formed so as to be oval.

FIG. 4*a* shows that a flange section 16 is provided on a longitudinal end of the oval-shaped seal 6. This flange section is formed as one piece with the seal. A pulse bore 17 is provided in the approximately semicircular-shaped flange section 16 and runs approximately axially parallel to the clear opening 18 of the seal.

According to FIG. 3, the cylinder flange 4 has a correspondingly formed cross section in order to completely accommodate the seal 6. In this way, a defined insert position of the seal in the flange opening 8 is provided.

The flange section 16 functions as a seal for a pulse channel 20 shown in FIG. 1. The pulse channel 20 is in a wall section 21 of the intake pipe 5 and runs approximately parallel to the longitudinal axis 31 of the pipe. The pulse channel 20 transmits the pressure fluctuations from the interior space of the crankcase via a pulse opening 19 introduced into the cylinder wall and via the pulse bore 17 in the flange section 16 to a membrane feed pump (not shown).

A liquid-tight and pressure-tight connection is provided between the pulse opening 19 in the cylinder wall and the pulse channel 20 in the wall section 21 of the intake pipe. This is achieved in that cylindrical stubs (32, 33) are provided on the cylinder wall and the intake pipe, respectively. The stubs (32, 33) engage friction-tight in the pulse bore 17 at both ends of the seal as shown in FIGS. 5 and 6. The pulse opening 19, the pulse bore 17 in the seal 6 and the pulse channel 20 in the intake pipe 5 are advantageously aligned coaxially to each other.

The intake pipe 5 and the carburetor housing 23 advantageously conjointly define a one-piece component thereby ensuring that the intake pipe is held on the cylinder flange so as to be essentially inseparable therefrom because the carburetor housing is fixedly attached on the engine housing.

According to FIG. 2, it can be advantageous to attach the intake pipe and/or the carburetor housing directly to the cylinder 2. For this purpose, an attachment bore 36 is provided in a wall section 35 configured as one piece with the intake pipe. An attachment element can be guided through the attachment bore 36 and hold the intake pipe on the cylinder. The axis 34 of the attachment bore 36 advantageously lies at a lateral distance with respect to the longitudinal axis 31 of the intake pipe so that the intake pipe can move axially by a small amount as a consequence of the one-sided lateral attachment. In this way, intense vibrations of the engine block can be compensated.

The outer surface of the end section 7 of the intake pipe can also have a slight conical inclination in order to facilitate introduction of the pipe end section into the seal 6. For this reason, the end face of the pipe end section can be provided with a bevel.

It is understood that the foregoing description is that of the preferred embodiments of the invention and that various changes and modifications may be made thereto without departing from the spirit and scope of the invention as defined in the appended claims.

What is claimed is:

1. An internal combustion engine for a portable handheld work apparatus such as a motor-driven chain saw or the like, the internal combustion engine comprising:

a cylinder defining a combustion chamber and having an inlet passage for conducting a fuel mixture into said combustion chamber;

said cylinder having an annular flange formed thereon and disposed in surrounding relationship to said inlet passage;

an intake pipe defining a longitudinal axis and having an end section;

said end section and said annular flange being axially inserted one into the other in overlapping relationship to each other;

said annular flange and said end section conjointly defining an annular space therebetween radially of said longitudinal axis; and, a seal clamped between said annular flange and said end section in said annular space.

2. The internal combustion engine of claim 1, said annular flange defining an opening communicating with said inlet passage; and, said end section of said intake pipe and said seal being inserted into said opening of said annular flange.

3. The internal combustion engine of claim 2, said seal being an annular seal and having a clear inner diameter; and, said end section of said intake pipe having an outer diameter (D) oversized with respect to said clear inner diameter of said annular seal.

4. The internal combustion engine of claim 3, said annular flange having an inner wall surface defining said opening and an inner annular shoulder defined by said inner wall surface and said annular flange having an annular flange wall extending from said annular shoulder; said inner annular shoulder facing toward said end section of said intake pipe; and, said annular flange wall surrounding and contact engaging said annular seal.

5. The internal combustion engine of claim 4, said annular flange wall having an axial elevation (H) measured in the direction of said longitudinal axis and said annular seal having an axial elevation (h) also measured in the direction of said longitudinal axis; and, said axial elevation (H) of said annular flange wall corresponding approximately to said axial elevation (h) of said annular seal.

6. The internal combustion engine of claim 4, said end section of said intake pipe having an end face facing toward said inner annular shoulder; and, said end face of said intake pipe and said inner annular shoulder conjointly defining an annular gap.

7. The internal combustion engine of claim 4, said end section of said intake pipe having an outer surface and said end section having an annular step formed in said outer surface thereof; and, said annular step coacting with said annular seal and said inner annular shoulder to limit the depth to which said end section can be inserted into said opening of said annular flange.

8. The internal combustion engine of claim 7, said cylinder having a wall and said inlet passage being formed in said wall; said inlet passage having an inner wall surface and said end section having an inner wall surface; and, said inner wall surfaces both lying in a common imaginary geometric surface.

9. The internal combustion engine of claim 3, said annular seal having an oval cross section.

10. The internal combustion engine of claim 9, said end section of said intake pipe having an approximately conical shape.

11. The internal combustion engine of claim 1, said annular seal having a flange section defining a pulse bore.

12. The internal combustion engine of claim 11, said annular seal defining a clear passage extending longitudinally therethrough; and, said pulse bore extending longitudinally through said flange portion axially parallel to said clear passage.

13. The internal combustion engine of claim 12, said cylinder having a wall and said inlet passage being formed in said wall and said cylinder further including a pulse channel formed in said wall so as to be coaxial with said pulse bore.

14. The internal combustion engine of claim 13, said end section of said intake pipe having a wall defining a channel communicating with said inlet passage; and, said wall of said end section defining a pulse channel communicating with said pulse channel formed in said wall of said cylinder.

15. The internal combustion engine of claim 1, further comprising a carburetor housing; and, said intake pipe and said carburetor housing conjointly defining a single piece.

* * * * *